United States Patent [19]

Barber

[11] 4,115,903

[45] Sep. 26, 1978

[54] PROCESSING OF FIBROUS MATERIALS TO REDUCE SAME TO A GENERALLY HOMOGENEOUS MASS OF FIBERS

[75] Inventor: Norman B. Barber, Cleckheaton, England

[73] Assignee: Garnett-Bywater Limited, Cleckheaton, England

[21] Appl. No.: 767,544

[22] Filed: Feb. 10, 1977

[51] Int. Cl.[2] ..... D01G 15/12

[52] U.S. Cl. ..... 19/99; 19/0.2

[58] Field of Search ..... 19/82, 83, 98, 99, 100, 19/105, 128, 0.2, 0.22, 0.23, 155-156.4; 200/61.09

[56] References Cited

U.S. PATENT DOCUMENTS

| | | | |
|---|---|---|---|
| 1,899,604 | 2/1933 | Anderson | 200/61.09 |
| 2,102,906 | 12/1937 | Merchant | 19/0.22 |
| 3,041,676 | 7/1962 | Goldman | 19/98 X |
| 3,051,996 | 9/1962 | Varga | 19/99 |
| 3,377,664 | 4/1968 | Keramas et al. | 19/105 |
| 3,790,990 | 2/1974 | Goldman | 19/99 X |
| 3,983,273 | 9/1976 | Elliott | 19/99 X |

FOREIGN PATENT DOCUMENTS

| | | | |
|---|---|---|---|
| 2,467 of | 1854 | United Kingdom | 19/99 |

*Primary Examiner*—Dorsey Newton
*Attorney, Agent, or Firm*—Harrington A. Lackey

[57] ABSTRACT

Fibrous materials are processed to produce a homogeneous mass of fibres by using a series of clothed cylinders, the fibrous material having passed from one cylinder to another. The cylinders progressively have coarser teeth, alternate cylinders rotating in different directions and the peripheral speeds of the cylinders are progressively greater. At least one worker roller is arranged tangentially with respect to two adjacent cylinders to work the material by rotating in the same direction as the slower peripheral speed roller. The flow of air is created along the path of travel of the material to cool and assist in transporting the material by encasing the cylinders in fitting cover means.

2 Claims, 3 Drawing Figures

PROCESSING OF FIBROUS MATERIALS TO REDUCE SAME TO A GENERALLY HOMOGENEOUS MASS OF FIBERS

This invention relates to a method of, and apparatus for processing fibrous material to reduce it to a generally homogeneous mass of fibres, such as a mass of textile fibres suitable for use in spinning and lap forming. The invention can also be applied to the processing of non textile fibres such as carbon fibres and metal fibres.

Proposals have been made for using conventional carding machines and garnetts for producing fibres for use in spinning and lap forming, in textile processing, but such proposals have resulted generally in machines which have limited production rates, and which tend to be large and expensive.

The present invention seeks to provide a method and apparatus which will be more suitable than the previous proposals.

According to this invention there is provided a method of processing fibrous materials to produce a homogeneous mass of fibres, wherein the fibrous material is treated by at least one group of clothed cylinders comprising a first treatment cylinder, a second treatment cylinder lying generally tangentially to the first cylinders, and a working cylinder lying generally tangentially to each of the first cylinder and the second cylinder, the cylinders being rotated so that the first and second cylinders rotate in opposte directions with the clothing of the second cylinder travelling faster than the clothing of the first cylinder, and the working cylinder rotates in the same direction as the first cylinder with the clothing thereof travelling slower than the clothing of each of the first and second cylinders, and wherein the fibrous material travels on the clothing of the first cylinder to where the second cylinder takes the fibrous material with a drafting and tearing effect, and the working cylinder takes knotted portions, slubs and impurities from the second cylinder and carries same round and returns same to the first cylinder clothing for reprocessing. Preferably, there are three groups of clothed cylinders, arranged in series, and the second clothed cylinder of the first group is also the first cylinder of the second group, and the second clothed cylinder of the second group is also first cylinder of the third group. The groups of cylinders are enclosed in a closely fitting casing serving to hold the fibrous materials to the cylinders, said casing having an inlet whereby fibrous material can be fed to the first cylinder of the first group, and an outlet whereby fibres can be discharged from the second cylinder of the third group.

The cylinders are preferably rotated at such speeds that at said outlet the fibres are at least mainly discharged by virtue of the velocity of the clothing and there is preferably a means creating an induced draught stripping fibres from the second roller from the third group.

The invention also provides a machine for processing fibrous material to produce a homogeneous mass of fibres, comprising at least one group of clothed cylinders comprising a first treatment cylinder, a second treatment cylinder lying generally tangentially to the first cylinder, and a working cylinder lying generally tangentially to each of the first cylinder and the second cylinder, the cylinders being adapted to be rotated so that the first and second cylinders rotate in opposite directions with the clothing of the second cylinder travelling faster than the clothing of the first cylinder, and the working cylinder rotating in the same direction as the first cylinder with the clothing thereof travelling slower than the clothing of each of the first and second cylinders, so that in use the fibrous material travels on the clothing of the first cylinder to where the second cylinder takes the fibrous material with a drafting and tearing effect, and the working cylinder takes knotted portions, slubs and impurities from the second cylinder and carries same round and returns same to the first cylinder clothing for reprocessing.

An embodiment of the invention will now be described by way of example, with reference to the accompanying drawings, wherein.

Figure 1:
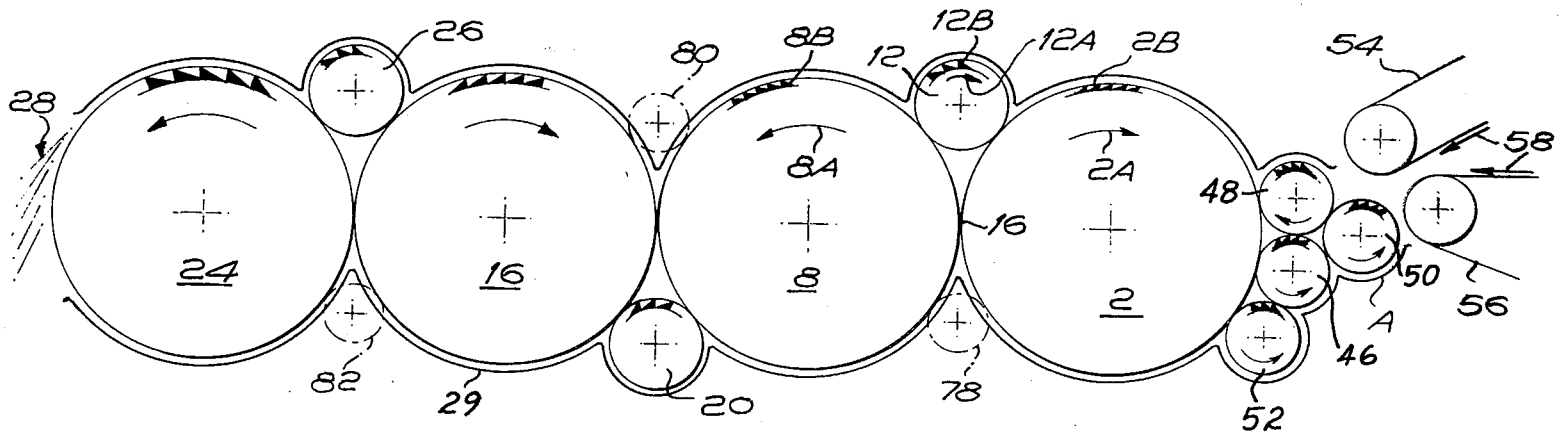
FIG. 1 is a diagrammatic side view of the feed assembly and clothing cylinders of the machine according to the embodiment of the invention.

Referring to the drawings, and firstly to FIG. 1, the machine can be considered as comprising three groups of clothed cylinders 2, 8, 12 forming one group, 8, 16 and 20 forming the second group, and 16, 24 and 26 forming the third group. It will be noticed that cylinder 8 and cylinder 16 are common to two groups. These groups of cylinders are arranged in series so that the fibrous material to be processed travels through the three groups of cylinders in sequence, the material being fed into the machine by a feed assembly A, and being ejected and removed from the machine as indicated by reference numeral 28, from the last cylinder 24.

Of each group of cylinders, there are certain common characteristics, therefore only one group of cylinders will be described in detail. Considering therefore the group comprising 2, 8 and 12, it will be seen that cylinders 2 and 8 are approximate tangential to define a transferring zone 16, and cylinder 12 is tangential to each of cylinders 2 and 8. Cylinders 2 and 8 are of identical size, whilst cylinder 12 is much smaller than each of cylinders 2 and 8. The cylinders are shown as rotating in the directions indicated by the arrows 2A, 8A and 12A respectively, and references 2B 8B and 12B show the clothing teeth formation of the respective cylinders, and the directions in which these teeth point in relation to the direction of rotation.

Considering the treatment effect on the fibrous material exercised by the first group comprising cylinders 2, 8 and 12, the fibrous material which may be loose clumps of waste material is grabbed by the forwardly projecting teeth of the clothing of cylinder 2 and is taken round by such teeth to zone 16 where cylinder 8 which is moving at a faster speed than cylinder 2, and has teeth which are correspondingly pitched to a greater extent proportanal to the speed differential, take the fibres with a combing and tearing effect, exercising a homogenising effect on the fibres. The cylinder 12 which rotates in the same direction as cylinder 2 exercises a working effect upon lumps in the fibrous material, in that the periphery of this cylinder 12 travels slower than that of cylinder 8 and cylinder 2, and the teeth are pointing backwards in relation to the direction of rotation. These teeth bar the passage of thick lumps such as knots and slubs in the fibrous material, and carry such thickened portions back to the clothing on the cylinder 2. The fast moving clothing teeth on the cylinder 2 tear these thick portions from cylinder 12 and return them to the feed zone A to intermingle with the incoming fibrous material.

Basically, the other roller groups operate in a similar manner, but at correspondingly increased speed, and the clothing on the cylinders 16 and 24 is increasingly coarser. The effect of this is that by the time the fibres reach the outlet region 28, they are being conveyed at high speed by cylinder 24 and are in a homogenous mass form. These fibres mainly are thrown off directly from cylinder 24 by the centrifugal action, as indicated by reference 28, but for any fibres remaining close to the clothing surface, held there by the static air which lies close to the cylinder surface, an angular deflector plate or blade, not shown, serves to breakup this static air layer, and separate such fibres from the cylinder 24.

Because the equipment operates at a high speed, the groups of cylinders are neatly encased by a casing 29, in order to hold the fibrous material to the various cylinders. Such casing has an inlet for the feed assembly A whereby the fibrous material can be fed to cylinder 2, and also has an outlet whereby ejection of the homogeneous mass of fibres can take place as indicated by reference numeral 28.

In a practical example, the cylinders 2, 8, 16 and 24 rotate so that their peripheral speeds are approximately as follows:

The respective groups of cylinders exercise a progressively more refining effect upon the fibrous material, and it will be appreciated that more or less groups can be used in any particular machine, depending upon the type of fibrous material being treated.

Furthermore, it is not necessary that the cylinders, 2, 8, 16 and 24 should be of the same size although this simplifies production, but the peripheral speeds of the cylinders 2, 8, 16, and 24 should in operation be progressively greater. The drive means for the various cylinders is shown in FIGS. 2 and 3 of the drawings, and such drive means will have facility for enabling any one cylinder 2, 8, 16 and 24 or roller 12, 20, 26 to be adjusted in speed to suit the particular fibrous material being treated.

Figure 2:
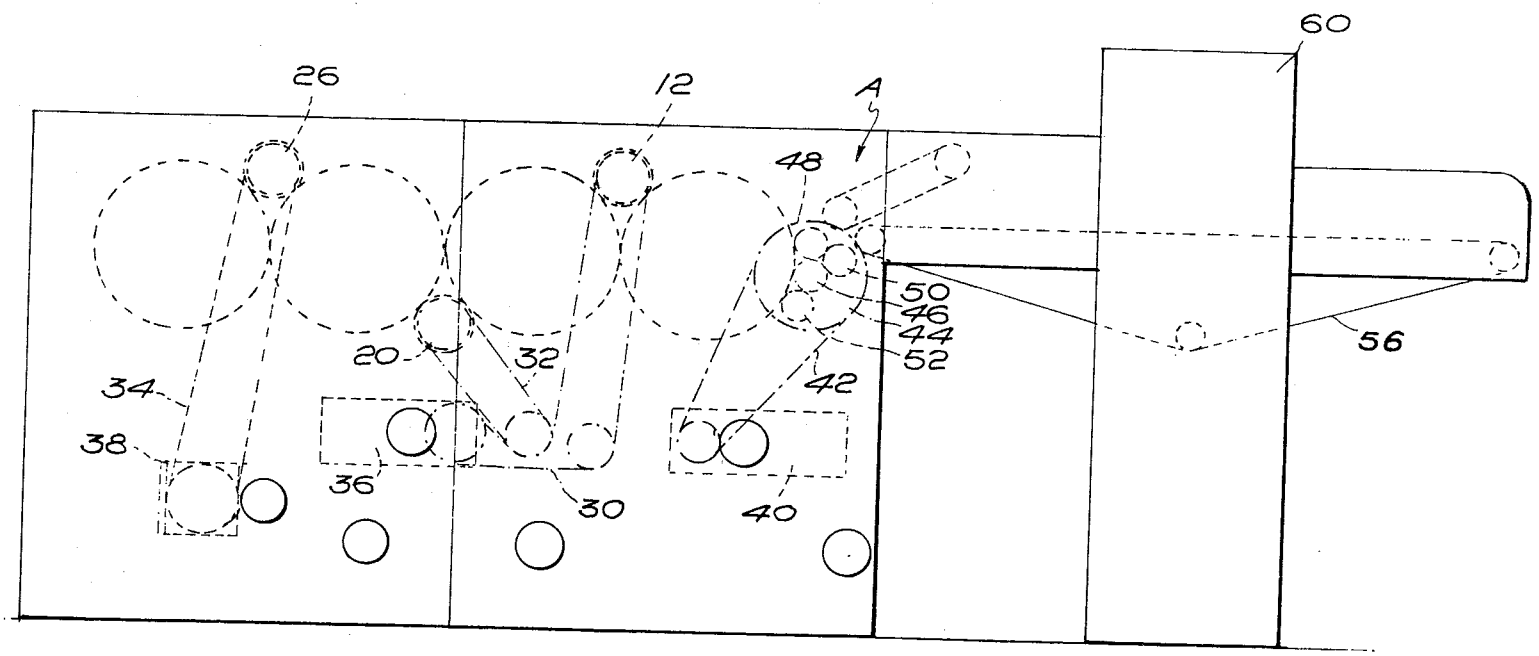
FIG. 2 is a side view of the machine of which the cylinders are shown in FIG. 1, the rear being taken from the same side.
Figure 3:
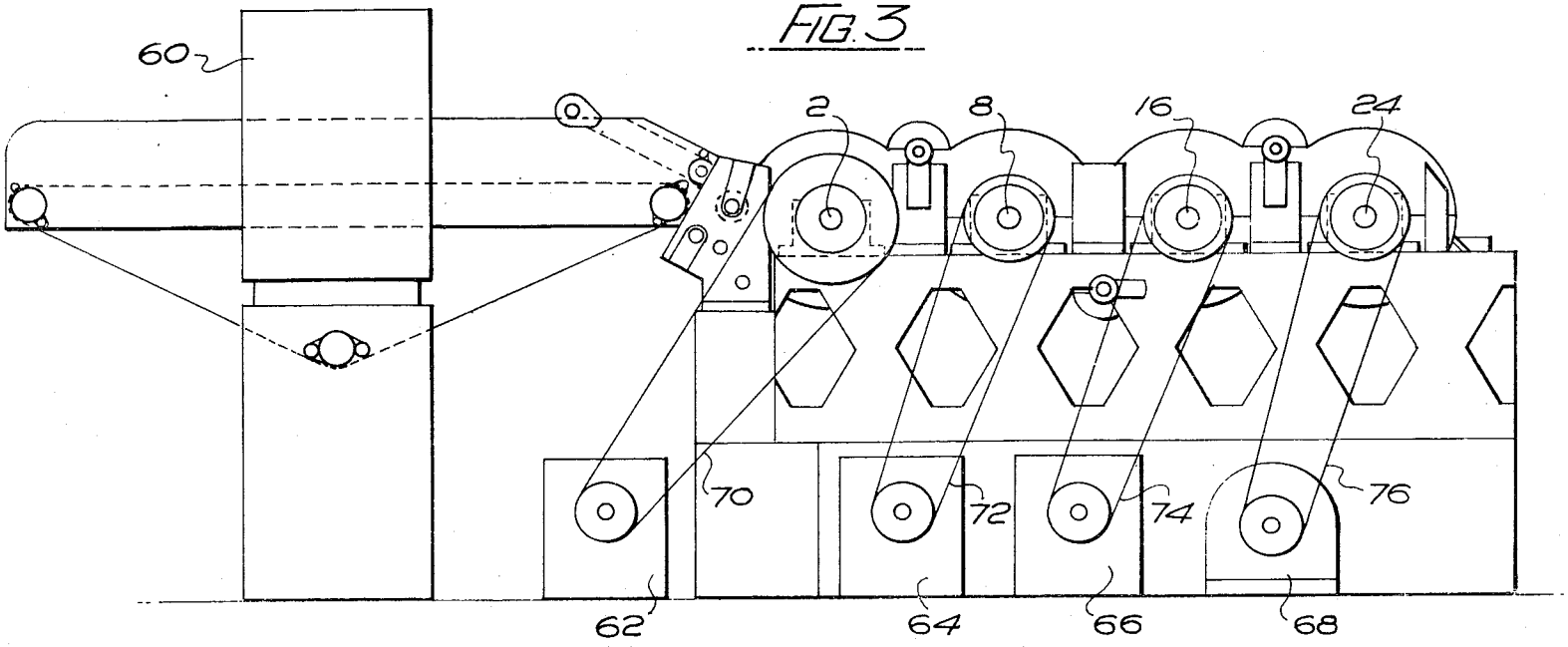
FIG. 3 is a side view; from the other side and with its drive guards removed, of the machine shown in FIG. 2.

Referring to FIGS. 2 and 3 the drive connections to cylinders 12, 20 and 26 are shown to comprise endless belts 30, 32 and 34, respectively, driven from two power units power unit 36 drives each of belts 30 and 32, while power unit 38 drives belt 34. Also shown in FIG. 2 is a third drive unit 40 which drives endless belt 42. Belt 42 engages a drive wheel 44 which drive the centre roller 46 of the group of rollers of the feed assembly A. The rollers 46 48, 50 and 52 of this group of rollers are geared together as to rotate as indicated by the arrows marked thereon in FIG. 1. These rollers 46 to 52 are also clothed and arranged tangentially as shown in FIG. 1. FIG. 1 also shows the direction in which the clothing teeth of the rollers 40 to 52 are inclined relative to the direction of rotation of the rollers. Feed means also includes a pair of driven endless bands 54 and 56, the opposite reaches of which are inclined and travel as indicated by the arrows 58 in FIG. 1 in order to feed the fibrous material into the nip between the rollers 48 and 50 of the feed assembly group of rollers. The supporting reach of the belt 56, as shown in FIG. 2, travels horizontally through a metal detection unit 60 so that fibrous material placed on the supporting reach of belt 56 will transport the material through the metal detector 60 which can, if desired, be arranged to remove such metal magnetically or by other means.

FIG. 3 shows the other side of the machine with the drive guards for the drive to the cylinders 2, 8, 16 and 24 removed. It will be appreciated that each of these cylinders 2, 8, 16 and 24 is driven independently from its own drive means 62, 64, 66 and 68 respectively through endless bands 70, 72, 74, and 76.

The apparatus and method described can be used for textile fibrous materials, or non-textile fibrous materials, such as carbon fibres, asbestos, metal fibres and even wood fibres.

Instead of the saw tooth clothing illustrated in the drawings, it is possible that the cylinders or one or more of the cylinders may be provided with an alternative form of clothing, such as steel pins. It is useful that the clothing should be progressively coarser the higher the speed the clothing is to travel.

As shown in FIG. 1 of the drawings, additional clothed or even plain rollers 78, 80 and 82 may be provided at the positions shown in phantom, if desired. These can assist in re-cycling some of the thick portions of the fibrous material.

It is preferred that the deflector plate 32 should be capable of adjustment, again to suit the type of fibrous material being handled.

What we claim is:

1. A method of processing fibrous materials to produce a homogeneous mass of fibres wherein, the method includes the steps of:

(a) feeding the fibrous material to the first clothed cylinder of a series of clothed cylinders of which series the clothing of each cylinder is coarser than the preceding cylinder, and the cylinders being so arranged that the fibrous material passes to the next and each subsequent cylinder in turn, being worked as it passes between cylinders, until it is discharged from the last cylinder as a mass of fibres;

(b) rotating adjacent cylinders of the series in opposite directions and so that the peripheral speed of each cylinder is greater than the preceding cylinder;

(c) working the material with at least one clothed worker roller arranged tangentially with respect to two adjacent cylinders of the series by rotating said worker roller in the same direction as the slower peripheral speed roller of said pair and having a peripheral speed less than that of the slower peripheral speed roller of said pair;

(d) creating a flow of air along the path of travel of the material to cool, and assist in transporting same by rotating the cylinders at a sufficiently high speed and by encasing the cylinders with cover means closely matching the peripheral shape of the cylinders and having only an inlet and outlet for the entry and escape of air.

2. A machine for processing fibrous materials to produce a homogeneous mass of fibres, comprising:

(a) a series of clothed cylinders of which the clothing of each cylinder is coarser than that of the preceding cylinder, (b) means for feeding the fibrous material to the first and finest clothed of said clothed cylinders, (c) means for driving adjacent cylinders in opposite directions at high speed and so that the peripheral speed of each cylinder is greater than that of the preceding cylinder;

(d) at least one working roller arranged tangentially with respect to two adjacent cylinders of said series and in working relation therewith so as to work on the material to remove impurities and slubs therefrom;

(e) means for driving the working roller in the same direction but at a slower peripheral speed than the finer clothed cylinder of said two cylinders;

(f) cover means encasing neatly the cylinders and the said at least one working cylinder and having an entry for the material and an exit for the fibres so that a flow of air along the path of travel of the material will be created when the machine is operative.

* * * * *